US006958454B2

(12) United States Patent
Sekine et al.

(10) Patent No.: US 6,958,454 B2
(45) Date of Patent: Oct. 25, 2005

(54) NAVIGATION SWITCH DEVICE

(75) Inventors: Takeshi Sekine, Yokohama (JP); Shingo Kume, Yokohama (JP); Taichi Tabata, Yokohama (JP); Akinori Oohira, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/504,834

(22) PCT Filed: Feb. 12, 2003

(86) PCT No.: PCT/JP03/01438

§ 371 (c)(1),
(2), (4) Date: Aug. 17, 2004

(87) PCT Pub. No.: WO03/069643

PCT Pub. Date: Aug. 21, 2003

(65) Prior Publication Data

US 2005/0110805 A1 May 26, 2005

(30) Foreign Application Priority Data

Feb. 18, 2002 (JP) ..... 2002-040214

(51) Int. Cl.[7] ..... H01H 25/04; H01H 9/00; H01H 1/06

(52) U.S. Cl. ..... 200/6 A; 200/275; 200/292; 200/313; 200/314

(58) Field of Search ..... 200/5 R, 5 A, 200/6 A, 18, 314, 512–517, 237–292, 308, 200/310, 313

(56) References Cited

U.S. PATENT DOCUMENTS

| | | | | |
|---|---|---|---|---|
| 4,246,452 A * | 1/1981 | Chandler | ..... | 200/5 A |
| 4,652,704 A * | 3/1987 | Franklin | ..... | 200/5 A |
| 4,668,843 A * | 5/1987 | Watanabe et al. | ..... | 200/5 A |
| 4,687,200 A * | 8/1987 | Shirai | ..... | 200/6 A |
| 5,536,911 A * | 7/1996 | Madill | ..... | 200/6 A |

FOREIGN PATENT DOCUMENTS

| | | | |
|---|---|---|---|
| EP | 1478001 A1 * | 11/2004 | ..... H01H 25/04 |
| JP | 58-176338 | 11/1983 | |
| JP | 61-149240 | 9/1986 | |

(Continued)

*Primary Examiner*—James R. Scott
(74) *Attorney, Agent, or Firm*—Pearne & Gordon LLP

(57) ABSTRACT

A navigation switch apparatus with simple construction is capable of operating in eight directions including longitudinal, lateral and diagonal directions. The apparatus has a printed circuit board having four conductors provided thereon with small spaces between each conductor. Together the conductors are shaped like a doughnut. A cap-shaped body arranged opposite the printed circuit board is provided with short-circuiters for making contact with the respective four conductors when a navigation lever is operated in the eight directions. Each conductor includes two opposing comb-shaped conductive layers. The central portion of one conductive layer has a diametrically directed comparatively-coarse comb shape. Both of the end portions of the other conductive layer have a circumferentially directed comparatively-fine comb shape, and the cap-shaped body has a thin-walled portion on its outer periphery. Thick-walled portions extending in the eight directions, and together forming a substantially regular octagon are formed in the vicinity of the thin-walled portion.

3 Claims, 2 Drawing Sheets

FOREIGN PATENT DOCUMENTS

| | | | | | |
|---|---|---|---|---|---|
| DE | 10024626 | A1 | * | 11/2001 | ..... H01H 25/04 |
| JP | 4-27537 | | | 3/1992 | |
| JP | 6-26132 | | | 4/1994 | |
| JP | 6-60038 | | | 8/1994 | |
| JP | 08212877 | A | * | 8/1996 | ..... H01H 25/04 |
| JP | 9-139143 | | | 5/1997 | |
| JP | 11-126126 | | | 5/1999 | |
| JP | 2001-101957 | | | 4/2001 | |
| JP | 2001351479 | A | * | 12/2001 | ..... H01H 25/04 |
| JP | 2002-304247 | | | 10/2002 | |

* cited by examiner

NAVIGATION SWITCH DEVICE

CROSS REFERENCE TO RELATED APPLICATIONS

This application claims priority of Japanese Patent Application No. 2002-040214, filed on Feb. 18, 2002 and which is incorporated herein by reference.

BACKGROUND OF THE INVENTION

The present invention relates to a navigation switch apparatus for use in PDAs, mobile telephones and so forth.

Generally in PDAs, mobile telephones and so forth, use has often been made of so-call navigation switch apparatus as change-over switches for switching functions by operating levers in the longitudinal, lateral and diagonal directions successively.

However, any one of these navigation switch apparatus is only so arranged that four conductors disposed longitudinally and laterally are solely formed with two opposed conductive layers, which are short-circuited by short-circuiters attached to the inner surface of a cap-shaped body. Therefore, almost any serious problem is not posed by a navigation switch apparatus of the sort mentioned above on condition that switching is confined to four directions including rightward, leftward, backward and forward directions. However, the problem is that in case where switching is carried out in eight directions including rightward, leftward, backward, forward and diagonal directions, the conventional navigation switch apparatus above can be of no practical use because a satisfactory detection angle in the diagonal direction is hardly securable.

An object of the invention intended to solve the foregoing problem is to provide a navigation switch apparatus simple in construction and capable of holding satisfactory detection angles in longitudinal, lateral and diagonal directions.

BRIEF SUMMARY OF THE INVENTION

In order to accomplish the object above, a navigation switch apparatus according to the invention has a doughnut-like printed circuit board as a whole having four conductors in the form of longitudinal and lateral segments of a circle with a small space provided between each pair of four conductors. Further, the navigation switch apparatus has a cap-shaped body arranged opposite to the printed circuit board and provided with short-circuiters capable of making contact with the respective four conductors and formed on the inner surface of the cap-shaped body, and a navigation lever formed on the outer surface thereof. Each of the four conductors is formed with two opposed comb-shaped conductive layers, and the cap-shaped body has a thin-walled portion on its outer periphery and thick-walled portions extending in the longitudinal, lateral and diagonal directions, thus forming a substantially regular octagon as a whole, are formed in the vicinity of the thin-walled portion.

With this arrangement, only a small space is provided between each pair of four conductors and when the navigation lever is operated in the diagonal direction, each short-circuiter accurately comes into contact with the adjoining conductor. Moreover, as the thick-walled portions extending in the longitudinal, lateral and diagonal directions, thus forming a substantially regular octagon as a whole, are formed on the outer periphery of the cap-shaped body, the thick-walled portions serve as guides when the navigation lever is operated in the longitudinal, lateral and diagonal directions, whereby the navigation lever is accurately operated in the longitudinal, lateral and diagonal directions even when the navigation lever is operated in any one of the longitudinal, lateral and diagonal directions.

The navigation switch apparatus according to the invention is provided with the conductors disposed longitudinally and laterally each of which is formed with the two opposed conductive layers such that the central portion of the one conductive layer is in a diametrically directed comparatively-coarse comb shape, whereas both the end portions of the other conductive layer are in a circumferentially directed comparatively-fine comb shape.

With this arrangement, detection angles in not only the longitudinal and lateral directions but also the diagonal direction become sufficiently secured, whereby it is possible to switch operating directions easily and accurately without any incorrect action.

The cap-shaped body of the navigation switch apparatus according to the invention is formed of a transparent material and light is introduced into the cap-shaped body from its end portion. The light introduced into the navigation lever is then emitted outside from the periphery of the navigation lever excluding a shading portion formed in its end portion.

With this arrangement, the navigation lever can easily be operated even in a dimly-lit place because the light introduced into the navigation lever from the periphery of the navigation lever excluding the shading portion formed in the end portion of the navigation lever, so that it is feasible to make the navigation switch apparatus elegant and unique in view of the external appearance.

Figure 1:
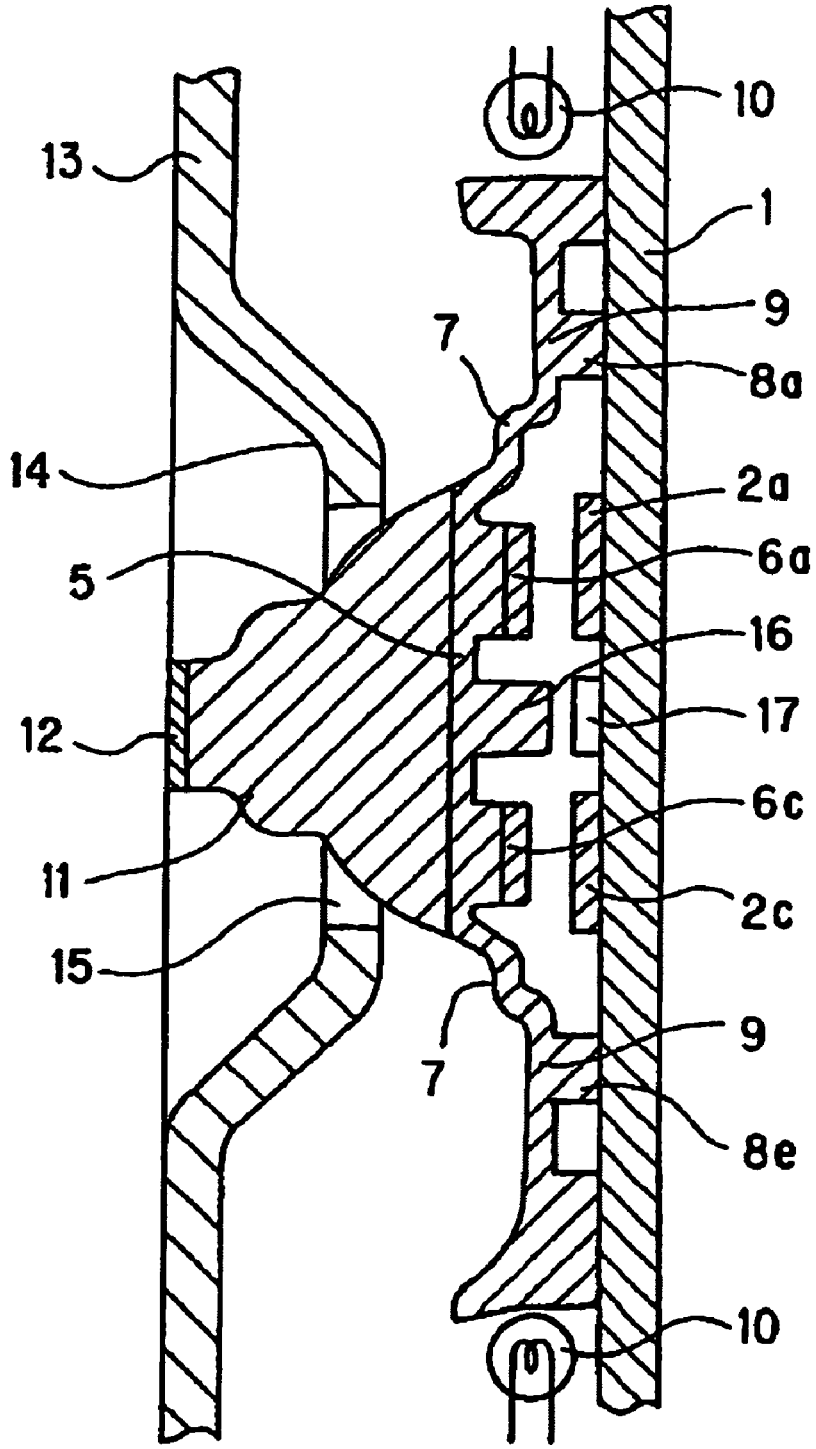
FIG. 1 is a schematic transverse sectional view of a navigation switch apparatus according to an embodying the invention.

Reference numerals and signs in the drawings denote as follows:

The numeral 1 designates a printed-circuit board. The numerals 2*a*, 2*b*, 2*c* and 2*d* designate respective conductors. The numerals 3*a*, 3*b*, 3*c* and 3*d* designate respective spaces. The numerals 4*a* and 4*b* designate respective conductive layers. The numeral 5 designates a cap-shaped body. The numerals 6*a*, 6*b*, 6*c* and 6*d* designate respective short-circuiters. The numeral 7 designates a thin-walled portion. The numerals 8*a*, 8*b*, 8*c*, 8*d*, 8*e*, 8*f*, 8*g* and 8*h* designate respective thick-walled portions. The numeral 9 designates a coupling portion. The numeral 10 designates a light-emitting body. The numeral 11 designates an operation part.

The numeral 12 designates a shading portion. The numeral 13 designates a casing. The numeral 14 designates a hollow portion. The numeral 15 designates a through-hole. The numeral 16 designates a projected portion. The numeral 17 designates a switch.

DETAILED DESCRIPTION OF THE INVENTION

An embodiment of the invention will now be described by reference to the drawings.

Figure 2:
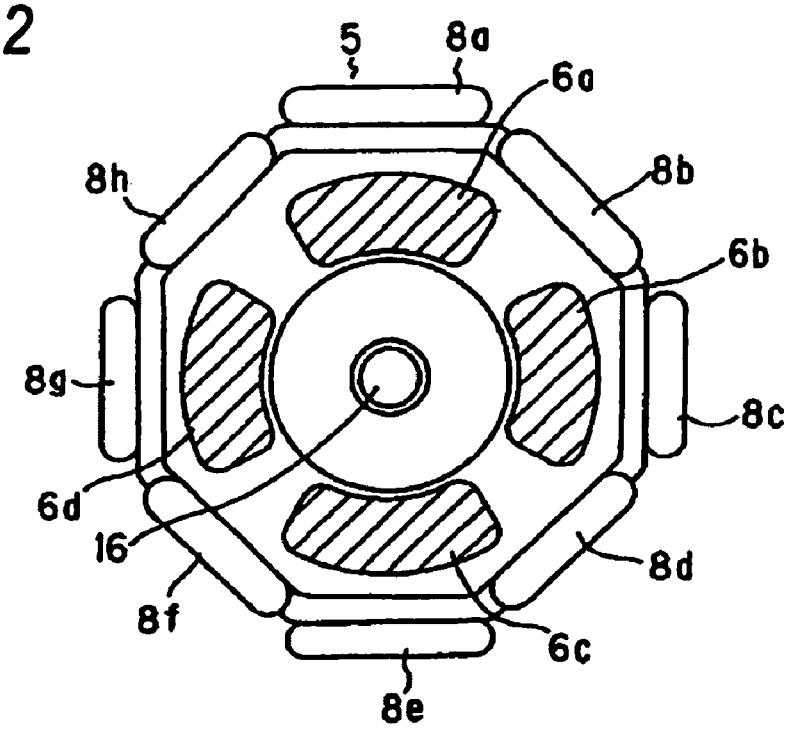
FIG. 2 is an internal view of a cap-shaped body as a component part of the navigation switch apparatus according to the embodiment of the invention.

FIG. 1 is a schematic transverse sectional view of a navigation switch apparatus according an embodiment of the invention; FIG. 2, an internal view of a cap-shaped body as a component part of the navigation switch apparatus according to the embodiment of the invention; and FIG. 3, a front elevational view of a printed-circuit board as a component part of the navigation switch apparatus according to the embodiment of the invention.

Figure 3:
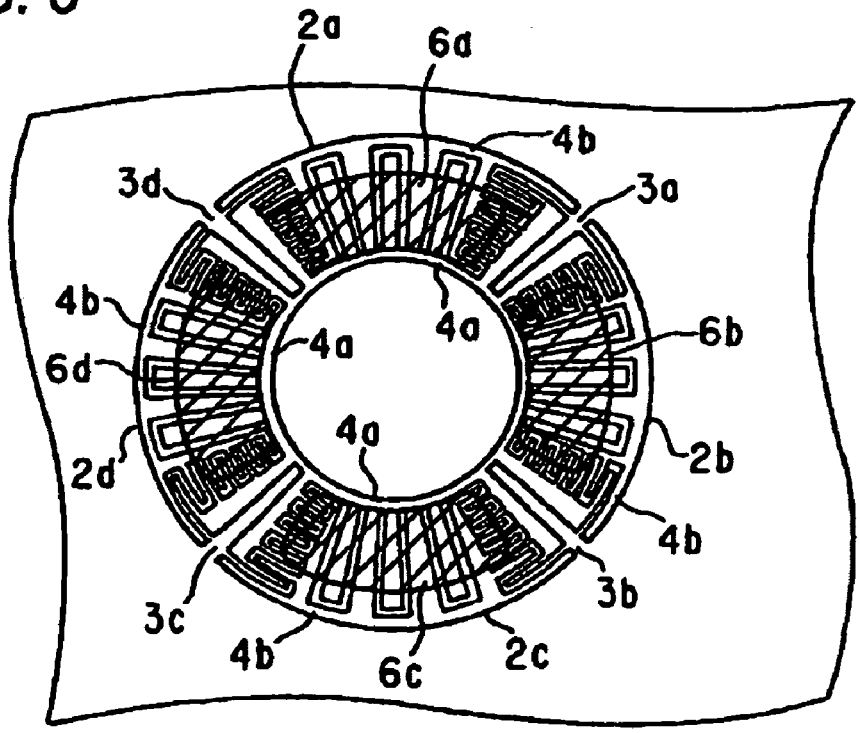
FIG. 3 is a front elevational view of a printed-circuit board as a component part of the navigation switch apparatus according to the embodiment of the invention.

As shown in FIGS. 1 to 3, the navigation switch apparatus according to the embodiment of the invention has a doughnut-like printed circuit board 1 as a whole having four conductors 2*a*, 2*b*, 2*c* and 2*d* in the form of segments of a circle on its surface with small spaces 3*a*, 3*b*, 3*c* and 3*d* provided longitudinally and laterally between the conductors 2*a* and 2*b*, 2*b* and 2*c*, 2*c* and 2*d*, and 2*d* and 2*a*, respectively. The navigation switch apparatus has a cap-shaped body 5 arranged opposite to the printed circuit board 1 and provided with short-circuiters 6*a*, 6*b*, 6*c* and 6*d* capable of making contact with the inner surfaces of the respective conductors 2*a*, 2*b*, 2*c* and 2*d*.

Each of the circular arc conductors 2*a*, 2*b*, 2*c* and 2*d* is as shown in FIG. 3 formed with two opposed conductive layers 4*a* and 4*b* such that the central portion of the one conductive layer is in a diametrically directed comparatively-coarse comb shape and both the end portions are in a circumferentially directed comparatively-fine comb shape. Further, out of the two conductive layers 4*a* and 4*b*, one conductive layer 4*a* positioned inside is directly linked to the other adjoining conductive layers 4*a*.

The cap-shaped body 5 has an outer peripheral thin-walled portion 7 and thick-walled portions 8*a*, 8*b*, 8*c*, 8*d*, 8*e*, 8*f*, 8*g* and 8*h* extending in the longitudinal, lateral and diagonal directions, thus forming a substantially regular octagon as a whole, are formed in the vicinity of the thin-walled portion 7. The thick-walled portions 8*b*, 8*d*, 8*f* and 8*h* extending diagonally are provided on the inner peripheral side of the thick-walled portions 8*a*, 8*c*, 8*e* and 8*g* extending longitudinally and laterally and formed slightly lower than the thick-walled portions 8*a*, 8*c*, 8*e* and 8*g* extending longitudinally and laterally.

Short-circuiters 6*a*, 6*b*, 6*c* and 6*d* attached onto the cap-shaped body 5 are as shown in FIGS. 2 and 3 in the form of segments of a circle and both end portions of each of the short-circuiters 6*a*, 6*b*, 6*c* and 6*d* are formed so as to properly face the circumferentially directed comb-shaped portions formed in both end portions of each of the conductors 2*a*, 2*b*, 2*c* and 2*d*.

The cap-shaped body 5 is coupled via a coupling part 9 to another cap-shaped body (not shown) forming another switch and formed of a transparent elastic material together with the coupling part 9 and the latter cap-shaped body (not shown). A light-emitting body 10 such as a lamp or a light-emitting diode is disposed in the end portion of the coupling part 9 and light from the light-emitting body 10 is introduced into the cap-shaped body 5 from the end portion of the coupling part 9.

A navigation lever 11 integral with the cap-shaped body 5 is formed on the outer surface of the central portion of the cap-shaped body 5 and a shading portion 12 that serves as a decor made of opaque metal material is formed in the front end portion of the navigation lever 11.

The front portion of the navigation lever 11 is arranged so as to project via a through-hole 15 from a hollow portion 14 formed in a casing 13. The light introduced into the cap-shaped body 5 is emitted outside the casing 13 from the navigation lever 11 excluding the shading portion 12 formed in the front end portion of the navigation lever 11.

A projected portion 16 integral with the cap-shaped body 5 is formed on the inner surface of the central portion and a switch 17 is attached to the printed circuit board 1 in a position opposite to the projected portion 16. In other words, the projected portion 16 is used for turning on/off the switch 17 when the navigation lever 11 is operated straightly in the axial direction.

A description will now be given of the operation of the navigation switch apparatus in accordance with the embodiment of the invention.

When the navigation lever 11 is operated in longitudinal and lateral directions, the cap-shaped body 5 correspondingly tilts longitudinally and laterally thereby and the short-circuiters 6*a*, 6*b*, 6*c* and 6*d* attached onto the cap-shaped body 5 come into contact with the conductors 2*a*, 2*b*, 2*c* and 2*d* formed on the printed circuit board 1. More specifically, the short-circuiter 6*a* comes into contact with the conductor 2*a* when the navigation lever 11 is operated forward and the short-circuiter 6*b* comes into contact with the conductor 2*b* when the navigation lever 11 is operated to the right; thus, the short-circuiters 6*a*, 6*b*, 6*c* and 6*d* come into contact with the conductors 2*a*, 2*b*, 2*c* and 2*d*. Then the conductive layers 4*a* and 4*b* constituting the conductors 2*a*, 2*b*, 2*c* and 2*d* are short-circuited, whereby the operation of the navigation lever 11 can accurately be detected.

A description will further be given of a case where the navigation lever 11 is operated in the diagonal direction.

When the navigation lever 11 is operated diagonally, the cap-shaped body 5 is also tilted diagonally. When the cap-shaped body 5 is tilted diagonally, two of the short-circuiters 6*a*, 6*b*, 6*c* and 6*d* come into contact with two of the conductors 2*a*, 2*b*, 2*c* and 2*d* facing the respective short-circuiters 6*a*, 6*b*, 6*c* and 6*d*, so that two of the conductive layers 4*a* and 4*b* constituting the respective conductors 2*a*, 2*b*, 2*c* and 2*d* are short-circuited. In other words, two of the short-circuiters 6*a*, 6*b*, 6*c* and 6*d* come into contact with two of the conductors 2*a*, 2*b*, 2*c* and 2*d* such that the short-circuiters 6*a* and 6*b* come into contact with the conductors 2*a* and 2*b* when the cap-shaped body 5 is tilted in the right forward diagonal direction and the short-circuiters 6*b* and 6*c* come into contact with the conductors 2*b* and 2*c* when the cap-shaped body 5 is tilted in the right backward diagonal direction, so that two of the conductive layers 4*a* and 4*b* constituting the respective conductors 2*a*, 2*b*, 2*c* and 2*d* are short-circuited. Therefore, even when the navigation lever 11 is operated diagonally, the operation of the navigation lever 11 can accurately be detected.

Incidentally, when the navigation lever 11 is operated in the diagonal direction, it is arranged to detect the direction in which the navigation lever 11 is tilted by causing two of the short-circuiters 6*a*, 6*b*, 6*c* and 6*d* to make contact with two of the conductors 2*a*, 2*b*, 2*c* and 2*d*. Consequently, the detection accuracy is greatly influenced by how accurately two of short-circuiters 6*a*, 6*b*, 6*c* and 6*d* are brought into contact with two of the conductors 2*a*, 2*b*, 2*c* and 2*d* and also how accurately two of the conductive layers 4*a* and 4*b* constituting the respective conductors 2*a*, 2*b*, 2*c* and 2*d* are short-circuited.

According to the embodiment of the invention, the thin-walled portion 7 is formed first in the outer peripheral portion of the cap-shaped body 5 and then the thick-walled portions 8*a*, 8*b*, 8*c*, 8*d*, 8*e*, 8*f*, 8*g* and 8*h* extending longitudinally, laterally and diagonally are formed so that these thick-walled portions form a substantially regular octagon as a whole in the vicinity of the thin-walled portion 7. When the navigation lever 11 is operated in the longitudinal, lateral and diagonal directions, the thick-walled portions 8*a*, 8*b*, 8*c*, 8*d*, 8*e*, 8*f*, 8*g* and 8*h* serve as guides, whereby the navigation lever 11 is accurately operated in the longitudinal, lateral and diagonal directions at all times.

According to the embodiment of the invention, comparatively large conductors 2*a*, 2*b*, 2*c* and 2*d* are formed on the printed circuit board 1 and only the small spaces 3*a*, 3*b*, 3*c* and 3*d* are provided between the conductors 2*a* and 2*b*, 2*b* and 2*c*, 2*c* and 2*d*, and 2*d* and 2*a*, respectively. When the navigation lever 11 is operated diagonally, two of the adjoining short-circuiters 6*a*, 6*b*, 6*c* and 6*d* accurately come into contact with two of the opposed conductors 2*a*, 2*b*, 2*c* and 2*d* and even in case that the navigation lever 11 is operated in a direction slightly shifted from the accurate diagonal direction, the navigation lever 11 can be perceived as what has accurately been operated diagonally. Thus, this arrangement can be understood to be of practical use.

According to the embodiment of the invention, the conductors 2*a*, 2*b*, 2*c* and 2*d* are formed with the comb-shaped conductive layers 4*a* and 4*b* set opposite to each other and when the navigation lever 11 is operated in the longitudinal, lateral and diagonal directions, two of the opposed conductive layers 4*a* and 4*b* of the respective conductors 2*a*, 2*b*, 2*c* and 2*d* can accurately be short-circuited by the short-circuiters 6*a*, 6*b*, 6*c* and 6*d*.

According to the embodiment of the invention, further, since each of the conductors 2*a*, 2*b*, 2*c* and 2*d* is as shown in FIG. 3 formed with two opposed conductive layers 4*a* and 4*b* such that the central portion of the one conductive layer is in the diametrically directed comparatively-coarse comb shape and both the end portions of the other conductive layer are in the circumferentially directed comparatively-fine comb shape, the conductive layers 4*a* and 4*b* can accurately be short-circuited by the short-circuiters 6*a*, 6*b*, 6*c* and 6*d* in both the end portions rather than the central portion and the advantage is that a detection angle in the diagonal direction grows larger. According to the actual measurement, the detection angle in the longitudinal and lateral directions was about 70 degrees and the detection angle in the diagonal direction was about 20 degrees in a case where all of the conductors 2*a*, 2*b*, 2*c* and 2*d* were formed in the diametrically directed comparatively-coarse comb shape. However, in the case where each of the conductors 2*a*, 2*b*, 2*c* and 2*d* is formed with two opposed conductive layers 4*a* and 4*b* which are in the diametrically directed comparatively-coarse comb shape in the central portion but in the circumferentially directed comparatively-fine comb shape in both the end portions as in the embodiment of the invention, the detection angle in the longitudinal and lateral directions was about 60 degrees and the detection angle in the diagonal direction was about 30 degrees, whereby it was possible to obtain detection angles that could sufficiently be put to practical use in any longitudinal, lateral and diagonal directions.

According to the embodiment of the invention, further, the cap-shaped body 5 is formed of the transparent elastic material and light from the light-emitting body 10 provided in the end portion is introduced inside and the light is emitted outside from the periphery excluding the shading portion 12 formed in the end portion of the navigation lever 11. Therefore, the navigation lever 11 can easily be operated even in a dimly-lit place because the light emitted from the light-emitting body 10 is brilliantly emitted outside from the periphery excluding the shading portion 12 formed in the end portion of the navigation lever 11 during the operation of the navigation lever 11, so that it is feasible to make the navigation switch apparatus elegant and unique in view of the external appearance.

Although a detailed description has been given of a specific embodiment of the invention, it is quite apparent to a person skilled in the art that various changes and modifications may be made in the invention without departing from the spirit and scope thereof.

What is claimed is:

1. A navigation switch apparatus comprising:

a circuit board having four conductors in the form of a circular arc, arranged thereon with a small space between each conductor so that whole the conductors form a doughnut-like shape; and a cap-shaped body arranged opposite to the printed circuit board, provided with short-circuiters which are capable of making contact with the respective four conductors and formed on the inner surface of the cap-shaped body, and a navigation lever formed on the outer surface thereof, wherein each of the four conductors is formed with two opposed comb-shaped conductive layers, wherein the cap-shaped body has a thin-walled portion on its outer periphery, and wherein thick-walled portions extending in the longitudinal, lateral and diagonal directions, thus forming a substantially regular octagon as a whole, are formed in the vicinity of the thin-walled portion.

2. The navigation switch apparatus as claimed in claim 1, wherein each of the conductors disposed longitudinally and laterally is formed with the two opposed conductive layers such that the central portion of the one conductive layer is in a diametrically directed comparatively-coarse comb shape, whereas both the end portions of the other conductive layer are in a circumferentially directed comparatively-fine comb shape.

3. The navigation switch apparatus as claimed in claim 1, wherein the cap-shaped body is formed of a transparent material and light emitted by a light-emitting body is introduced into the cap-shaped body from an end portion, and wherein the light introduced into the navigation lever is then emitted outside from the periphery of the navigation lever excluding a shading portion formed in the end portion.

* * * * *

UNITED STATES PATENT AND TRADEMARK OFFICE

CERTIFICATE OF CORRECTION

PATENT NO. : 6,958,454 B2
DATED : October 25, 2005
INVENTOR(S) : Sekine et al.

It is certified that error appears in the above-identified patent and that said Letters Patent is hereby corrected as shown below:

Column 6,
Line 38, insert:
-- As set forth above, according to the invention, only a small space is provided between each pair of four conductors and even when the navigation lever is operated in the diagonal direction, the short-circuiters are so arranged as to come into contact with the respective adjoining conductors. Moreover, the thick-walled portions directed vertically, horizontally and diagonally, thus forming a substantially regular octagon as a whole, are formed on the outer periphery of the cap-shaped body. Therefore, the thick-walled portions serve as guides when the navigation lever is operated in the longitudinal, lateral and diagonal directions and the advantage is that the navigation lever can accurately be operated in any one of the longitudial, lateral and diagonal directions. --.

Signed and Sealed this

Seventh Day of February, 2006

JON W. DUDAS
*Director of the United States Patent and Trademark Office*